US008970371B2

(12) United States Patent
Di Marco et al.

(10) Patent No.: US 8,970,371 B2
(45) Date of Patent: Mar. 3, 2015

(54) SELF-CONTAINED DETECTION METHOD AND DEVICE

(75) Inventors: Stéphane Di Marco, Nanterre (FR); Laurent Pichard, Nanterre (FR)

(73) Assignee: Finsecur, Nanterre (FR)

( * ) Notice: Subject to any disclaimer, the term of this patent is extended or adjusted under 35 U.S.C. 154(b) by 114 days.

(21) Appl. No.: 13/579,086

(22) PCT Filed: Feb. 17, 2011

(86) PCT No.: PCT/FR2011/050335

§ 371 (c)(1),
(2), (4) Date: Nov. 21, 2012

(87) PCT Pub. No.: WO2011/101597

PCT Pub. Date: Aug. 25, 2011

(65) Prior Publication Data

US 2013/0063263 A1 Mar. 14, 2013

(30) Foreign Application Priority Data

Feb. 17, 2010 (FR) ..... 10 00674

(51) Int. Cl.

| | |
|---|---|
| ***G08B 21/00*** | (2006.01) |
| ***G08B 29/12*** | (2006.01) |
| ***G08B 1/08*** | (2006.01) |
| ***G08B 29/14*** | (2006.01) |

(52) U.S. Cl.

CPC ..... *G08B 29/126* (2013.01); *G08B 1/08* (2013.01); *G08B 29/14* (2013.01)

USPC ..... 340/540; 340/577; 340/628; 340/630; 340/632

(58) Field of Classification Search

CPC ..... G08B 29/00; G08B 29/14; G08B 29/18; G08B 29/06; G08B 29/126; G08B 29/145; G08B 1/08; G08B 21/00

USPC ..... 340/540, 584, 630, 632, 531, 573.1, 340/514, 577, 581, 628

See application file for complete search history.

(56) References Cited

U.S. PATENT DOCUMENTS

| | | | | |
|---|---|---|---|---|
| 4,150,370 | A * | 4/1979 | Bradshaw | 340/518 |
| 4,340,885 | A * | 7/1982 | Chavis et al. | 340/632 |
| 4,631,527 | A * | 12/1986 | De Witt et al. | 340/539.3 |
| 4,785,289 | A * | 11/1988 | Chen | 340/527 |
| 5,148,158 | A | 9/1992 | Shah | |
| 5,159,315 | A * | 10/1992 | Schultz et al. | 340/539.26 |
| 5,908,600 | A * | 6/1999 | Simi et al. | 422/90 |
| 2006/0202813 | A1 * | 9/2006 | Morris | 340/514 |
| 2007/0146127 | A1 | 6/2007 | Stilp et al. | |
| 2008/0266121 | A1 * | 10/2008 | Ellul | 340/584 |

* cited by examiner

*Primary Examiner* — Hung T Nguyen
(74) *Attorney, Agent, or Firm* — IM IP Law PLLC; C. Andrew Im

(57) ABSTRACT

The detection device comprises a sensor, a power supply, an alarm and an acousto-electric transducer. The activated acousto-electric transducer receives an acoustic signal and emits an electrical signal representative of the acoustic signal. The detection device further comprises a means of recognizing a predefined acoustic signal according to the electrical signal emitted by the transducer and triggering an emission of a message by the alarm when the predefined acoustic signal is recognized. The acoustic-electric transducer is only activated at regular intervals. Preferably, the transducer also serves an alarm to emit the message when the predefined acoustic signal is recognized.

18 Claims, 5 Drawing Sheets

SELF-CONTAINED DETECTION METHOD AND DEVICE

RELATED APPLICATIONS

This application is a §371 application from PCT/FR2011/050335 filed Feb. 17, 2011, which claims priority from French Patent Application No. 10 00674 filed Feb. 17, 2010, each of which is incorporated herein by reference in its entirety.

TECHNICAL FILED OF THE INVENTION

This invention concerns an autonomous detection method and device. It applies in particular to autonomous domestic detectors, particularly of smoke, gas, notably carbonic, fire or flames.

BACKGROUND OF THE INVENTION

Autonomous domestic detectors basically comprise at least one sensor, for example of smoke or heat, at least one alarm, generally audible, an autonomous power supply, in the form of a battery, and a test button. This test button serves to trigger a signal emitted by the alarm to confirm that the detector is operating correctly.

However, the best position of such a detector is on the ceiling and reaching the button is difficult, especially for persons with reduced mobility. Because the test button is difficult to reach many users never test their detectors, so that these are no longer in operating condition.

OBJECT AND SUMMARY OF THE INVENTION

The aim of this invention is to remedy these disadvantages.

To this end, according to a first aspect, this invention envisages a detection device, comprising a sensor, a power supply and an alarm, which comprises:

- an acousto-electric transducer designed, when it is active, to receive an acoustic signal and emit an electrical signal representative of the acoustic signal and
- a means of recognizing a predefined acoustic signal according to the electrical signal emitted by said transducer and triggering the emission of a message by said alarm when said predefined signal is recognized;

the acoustic-electric transducer is only activated at regular intervals.

Thanks to these provisions, the detection device's test function can be controlled remotely without utilizing a remote control, hertzian communication or other means of remote communication, for example utilizing WiFi (acronym for Wireless Fidelity) or Bluetooth (registered trademark) standards, which entail the use of costly components and also significant electrical consumption that are contrary to the autonomy of the detection means.

According to particular features, said alarm is an electro-acoustic transducer and is combined with the acousto-electric transducer.

For example, the audible alarm comprises a loud-speaker or a piezoelectric material and the return signals received by the audible alarm serve to detect the predefined sound signal. Implementing this invention is therefore particularly inexpensive.

According to particular features, the detection device that is the subject of this invention comprises a microphone.

Thanks to these provisions, sensitivity to sound signals is increased.

According to particular features, the detection device that is the subject of this invention comprises a means of analyzing values of an operating parameter of the device and a means of generating the message designed so that said message is representative of said value.

According to particular features, the means of analyzing values of different operating parameters of the device is designed to estimate a quantity of energy remaining available in an autonomous power supply; the message is representative of said energy quantity.

For example, the analysis means is designed to determine the quantity of energy remaining available in an autonomous power supply and/or a useful life of the electrical power supply; the message indicates the available energy level.

According to particular features, the recognition means is also designed to detect a predefined signal requesting a temporary suspension of the detection device's operation and, as a result, to trigger the suspension of the detection device's operation for a predefined length of time.

For example, when the user has guests who smoke, lights a fire in the fireplace or cooks food on a portable stove, smoke or fire detection can be suspended for a few hours.

According to particular features, the recognition means is designed to recognize a human voice and a message conveyed by said voice.

Thanks to these provisions, the user can vocally control the detection device's test function.

According to particular features, the detection device comprises a means of generating a sound message designed to be recognized by a detection device that is the subject of this invention, as described in brief above.

Thanks to these provisions, detection devices can communicate with each other.

According to particular features, the detection device comprises a means of generating a sound message designed to be recognized by a home automation device.

Thanks to these provisions, the detection device can have its status remotely communicated, or centralized with those of other detection devices, by the home automation device so that the user can easily obtain the communication of this status.

According to particular features, the device that is the subject of this invention, as described in brief above, comprises an indicator light commanded to emit a light signal at regular time intervals; the acousto-electric transducer and its amplification means are only activated during part of the time interval following the emission of the light signal.

Thanks to these provisions, the detection device's electrical consumption is reduced because recognition of the predefined sound signal is only intermittently active.

According to a second aspect, this invention envisages an electronic device, which comprises a means of emitting predefined sound signals likely to be recognized by a detection device that is the subject of this invention, as described in brief above.

According to particular features, the electronic device that is the subject of this invention consists of a mobile telephone.

According to a third aspect, this invention envisages a detection system comprising:

- a detection device that is the subject of this invention as described in brief above, whose acousto-electric transducer and its amplification means are only activated at regular time intervals, and
- an electronic device that is the subject of this invention designed to emit the predefined sound signal during a length of time greater than the time interval and, preferably, twice the time interval.

Thanks to these provisions, the detection device's electrical consumption is reduced because recognition of the predefined sound signal is only intermittently active.

According to a fourth aspect, this invention envisages a server that comprises means of receiving a request from an electronic device and means of providing a predefined sound signal likely to be recognized by a detection device that is the subject of this invention.

According to a fifth aspect, this invention envisages a detection method utilizing a sensor, a power supply and an alarm, which comprises:

- a step of activating an acousto-electric transducer at regular time intervals,
- a step of receiving an acoustic signal by said activated transducer and
- a step of recognizing a predefined acoustic signal and triggering the emission of a message by the alarm when said predefined signal is recognized.

According to a sixth aspect, this invention envisages a method of emitting a predefined sound signal, which comprises a step of triggering a function of an electronic device and a step of emitting the predefined sound signal likely to be recognized by a detection device that is the subject of this invention.

According to a seventh aspect, this invention envisages a method of providing a sound signal, which comprises a step of receiving a request from an electronic device and a step of providing a predefined sound signal likely to be recognized by a detection device that is the subject of this invention.

As the particular characteristics, advantages and aims of this electronic device, this detection system, this server and of these methods are similar to those of the device that is the subject of this invention, as described in brief above, they are not repeated here.

BRIEF DESCRIPTION OF THE DRAWINGS

Other advantages, aims and particular features of the present invention will become apparent from the description that will follow, made, as a non-limiting example, with reference to drawings included in an appendix, in which.

DETAILED DESCRIPTION OF THE EMBODIMENTS

Figure 1:
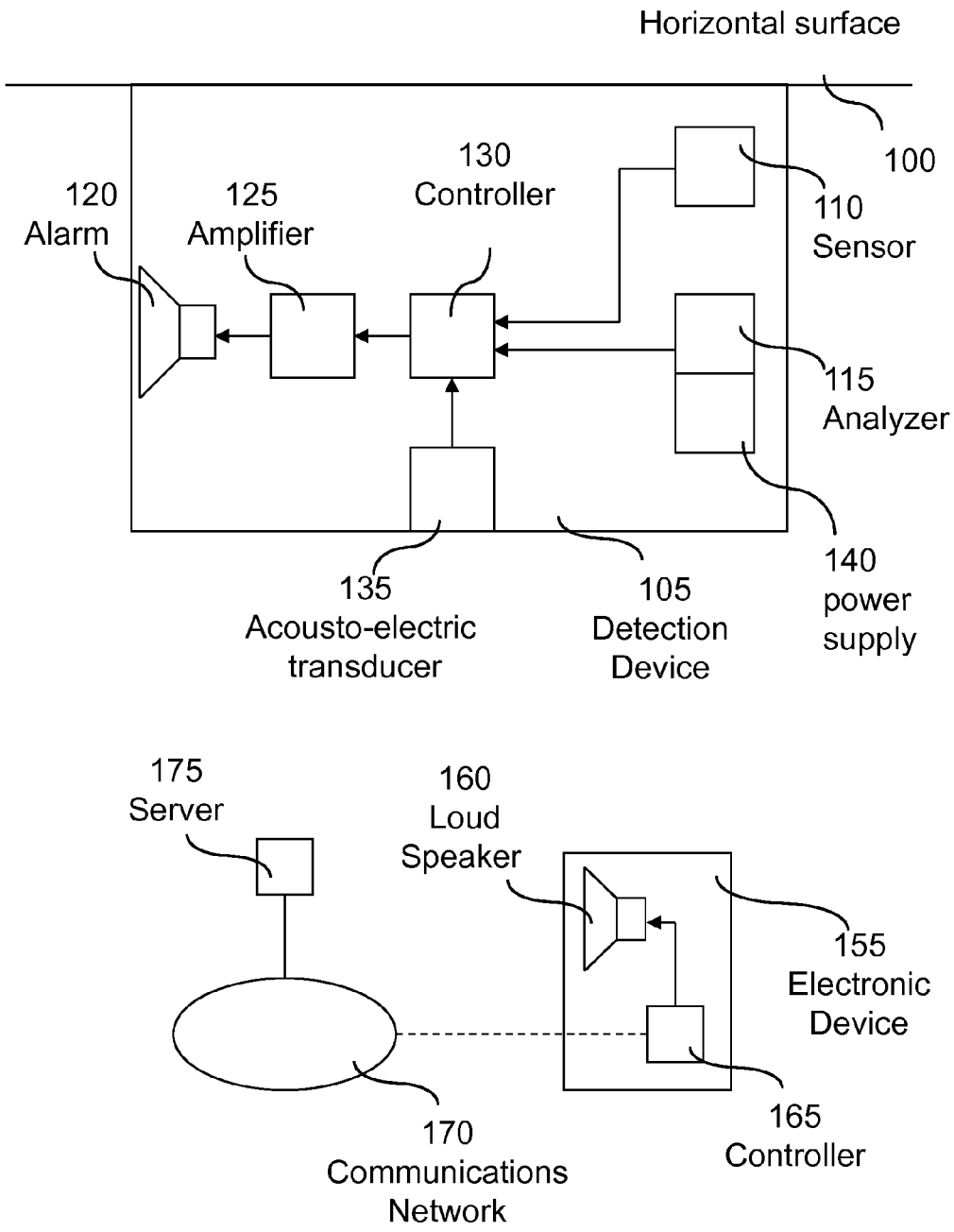
FIG. 1 represents, schematically, a first particular embodiment of the device that is the subject of this invention.
Figure 2:
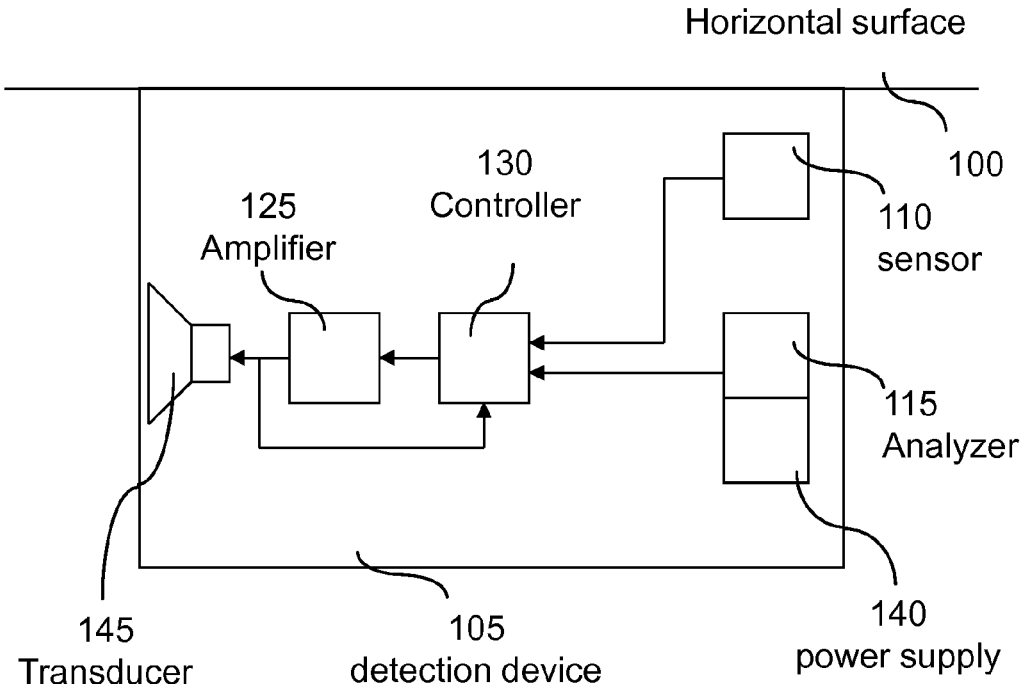
FIG. 2 represents, schematically, a second particular embodiment of the device that is the subject of this invention.
Figure 2:
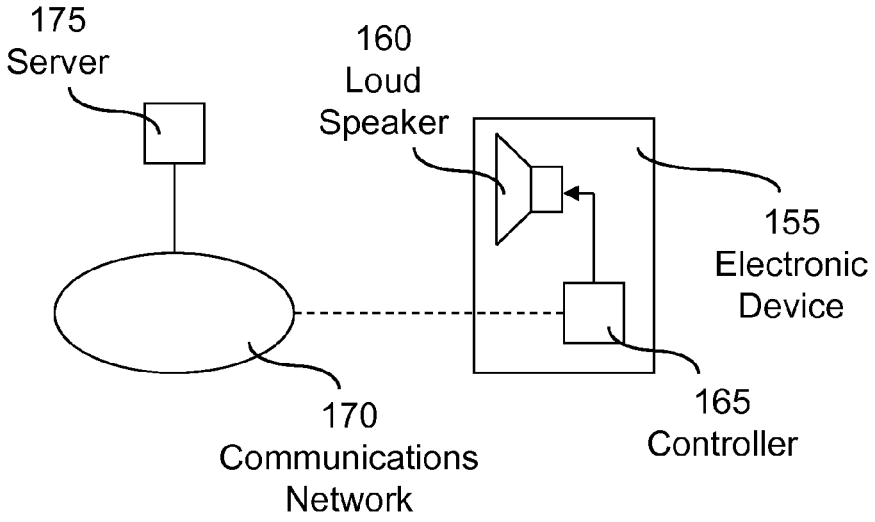
Figure 4:
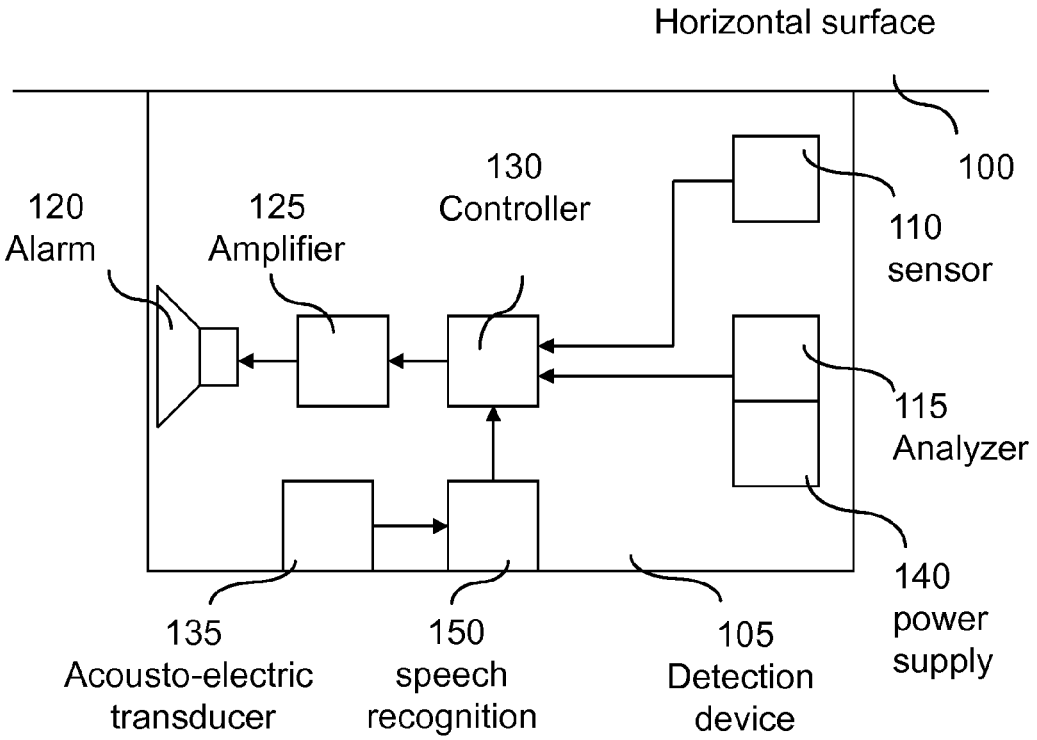
FIG. 4 represents, schematically, a third particular embodiment of the device that is the subject of this invention.

It is now noted that device FIGS. 1, 2 and 4, are not to scale.

FIG. 1 shows, attached to a horizontal surface 100, for example a ceiling, a detection device 105 that is the subject of this invention, which comprises a sensor 110, a power supply 140 and an alarm 120.

The sensor 110 is designed to detect a predefined value of a physical quantity external to the device 105, for example the presence of smoke or heat greater than a limit value.

The power supply 140 is autonomous, i.e. it is not permanently linked to a constant energy source, e.g. mains power. The power supply 140 consists, for example, of at least one battery or a storage battery.

The alarm 120 is represented here as an audible alarm, e.g. consisting of a loud-speaker or a piezoelectric material. In a variant, the alarm 120 comprises a luminous alarm, e.g. a light source.

The device 105 also comprises a control means 130, an amplifier 125, a means of analyzing 115 the status of the electrical power supply 140 and an acousto-electric transducer 135.

The acousto-electric transducer 135 is designed to receive an acoustic signal and emit an electrical signal representative of the acoustic signal. It consists, for example, of a microphone, e.g. an electret microphone.

Figure 3:
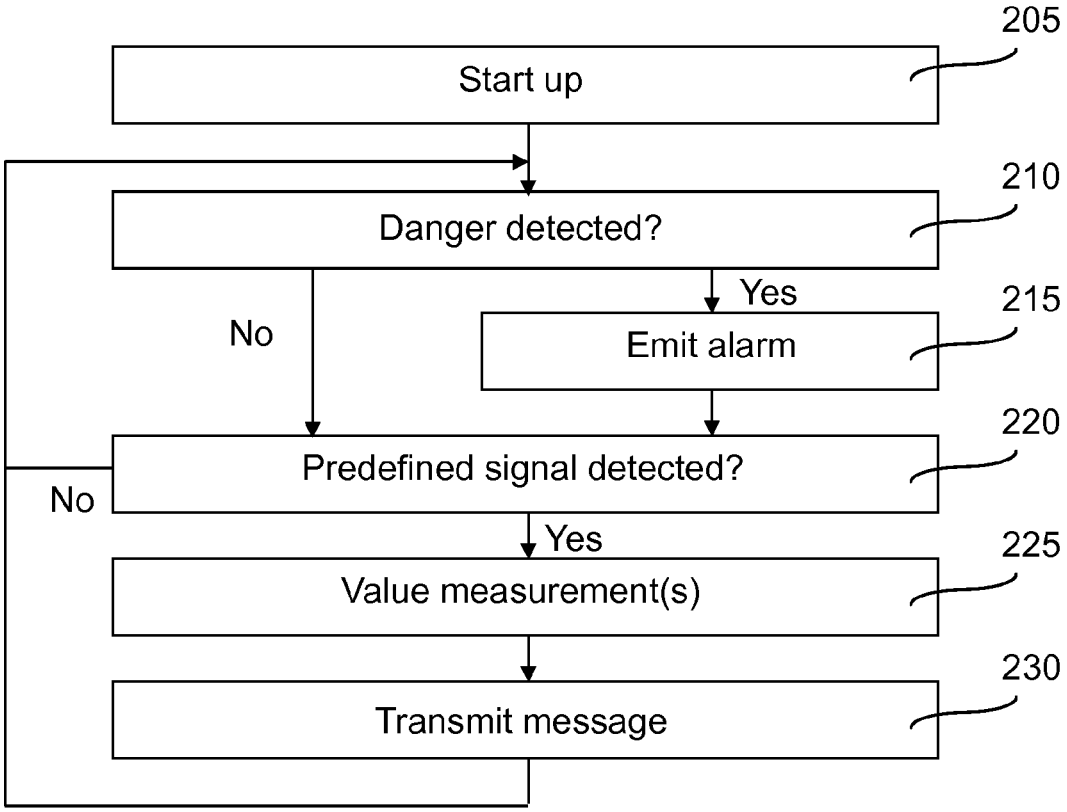
FIG. 3 represents, in the form of a logical diagram, steps utilized in a first particular embodiment of the method that is the subject of this invention.

The control means 130 consists, for example, of a microprocessor associated with a non-volatile memory storing a program implementing the steps illustrated in FIG. 3, in addition to the standard operational steps of an autonomous detection device. The control means 130 receives:

- a signal representative of the detection of the predefined value of the external physical quantity emitted by the sensor 110,
- a signal representative of the battery status emitted by the analysis means 115 and
- the electrical signal emitted by the acousto-electric transducer 135.

The control means 130 emits on output a signal representative of a sound message, notably an alarm or test message, to the amplifier 125. The amplifier 125 is, in a way known per se, designed to amplify signals emitted by the control means 130 and transmit the amplified signals to the alarm 120 so that it emits sound signals.

In the embodiment shown in FIG. 1, the control means 130 forms a means of recognizing a predefined acoustic signal according to the electrical signal emitted by the transducer 135 and triggering the emission of a message by the alarm 120 when said predefined signal is recognized.

In the bottom of FIG. 1 an electronic device 155, a communications network 170 and a server 175 are shown. The electronic device 155, preferably portable, consists, for example, of a mobile telephone, a personal digital assistant (or "PDA") or a portable computer. It may, however, consist of a desktop computer or a home automation system.

The electronic device 155 comprises a loud-speaker 160 and a control means 165, for example a microprocessor. The loud-speaker 160 is electromagnetic or a piezoelectric material. The control means 165 is designed to communicate with the server 175, via the communications network 170, to receive sound signals able to be recognized by the control means 130. The communications network 170 is, for example, a telephone network or a computer network, e.g. Internet. The server 175 is a voice server or a computer server. When called by the electronic device 155, the server 175 delivers a sound message, vocally or in a digital message. In both cases, the sound message can be stored in the memory of the electronic device 155 and/or transmitted immediately by the loud-speaker 160.

The sound signals designed to be recognized are, for example, DTMF (acronym for "Dual Tone Modulated Frequencies") signals, well known in the telephone world. Preferably, these sound signals comprise a succession of frequencies of a predefined duration, so that detecting their reception is surer and cannot be confused with other natural or artificial sounds.

To this end, the electronic device 155 comprises a keyboard or a key (not shown) for triggering the call of the server 175 and/or the emission of the stored sound signal.

To test the detection device 105, the user calls the server 175 or reads the sound message, which they keep in memory after receiving it from this server 175, and has this transmitted by the loud-speaker 160. When this sound message is received, the control means 130 recognizes the predefined sound signal, reads the status of the power supply 140 and has the alarm 120 emit a sound message. This latter sound message is representative of the operating condition of the device 105. It is noted that the lack of an emission lets the user know that the device 105 is not in operational condition. The sound message can therefore be a single pulse or the alarm signal, reduced to an emission of about one second. In other embodiments, the frequency of a sinusoidal sound wave decreases with the level of energy available in the electrical power supply 140 or the ratio of the duration of an intermittent signal's silences to the duration of the emission of signals increases as the level of energy available in the power supply 140 decreases. In further embodiments, the sound message emitted by the alarm 120 is more complex, may be up to a synthetic voice signal.

In a variant the sound signal emitted by the alarm 120 is captured by the electronic device 155 and transmitted to the server 175, which determines the status of the detection device. In this case, preferably, the sound signal emitted by the alarm 120 is representative of an identifier of the detection device 105, for example its serial number stored in non-volatile memory associated to the control means 130. In this case, the server 175 can store an item of information representative of the detection device tests carried out, as well as the dates of these tests. This storage allows the user to prove that they have carried out the detection device tests at regular intervals, e.g. at a frequency specified by regulations. Preferably, in this case the server 175 has an electronic mail sent to an electronic address of the user to attest to the fact that the specified tests have been carried out. Preferably, at the end of the regulatory period or the period specified by the manufacturer of the detection device 105, the server 175 transmits an electronic mail inviting the user to carry out another test of each detection device.

The second embodiment, shown in FIG. 2, has all the elements of FIG. 1 except for the transducer 135 and the alarm 120. In this second embodiment, these two elements are replaced by a transducer 145 that serves as both alarm and acousto-electric transducer.

The first embodiment of the method that is the subject of this invention, illustrated in FIG. 3, shows a step of starting up 205 the detection device.

During a step 210, the control means 130 determines, according to the signal it receives from the sensor 110, whether a danger has been detected, by means of the value of the physical quantity detected by the sensor 110. If yes, during a step 215 the control means 130 has the alarm 120 or 145 emit an alarm signal. Otherwise, or after step 215, during a step 220 the control means 130 determines whether it recognizes a predefined sound signal.

If not, return to step 210. In contrast, if the predefined sound signal is recognized the control means causes at least one operating parameter value of the detection device 105, for example the status of the electrical power supply 140, to be measured during a step 225. Then, during a step 230, the control means triggers the emission of a message by the alarm 120, for example a sound message representative of the level of energy available in the electrical power supply 140.

Thanks to the utilization of the device and/or method that are the subjects of this invention, a user can test each of their detection devices without having to physically reach the detection device. Thus it is easier to respect the regularity of the operating tests.

FIG. 4 shows, in a third embodiment of the detection device, the same elements as in FIG. 1, to which are added speech recognition means 150, inserted between the transducer 135 and the control means 130. In this embodiment, the user tests the detection device's operation by giving it a voice instruction.

Figure 5:
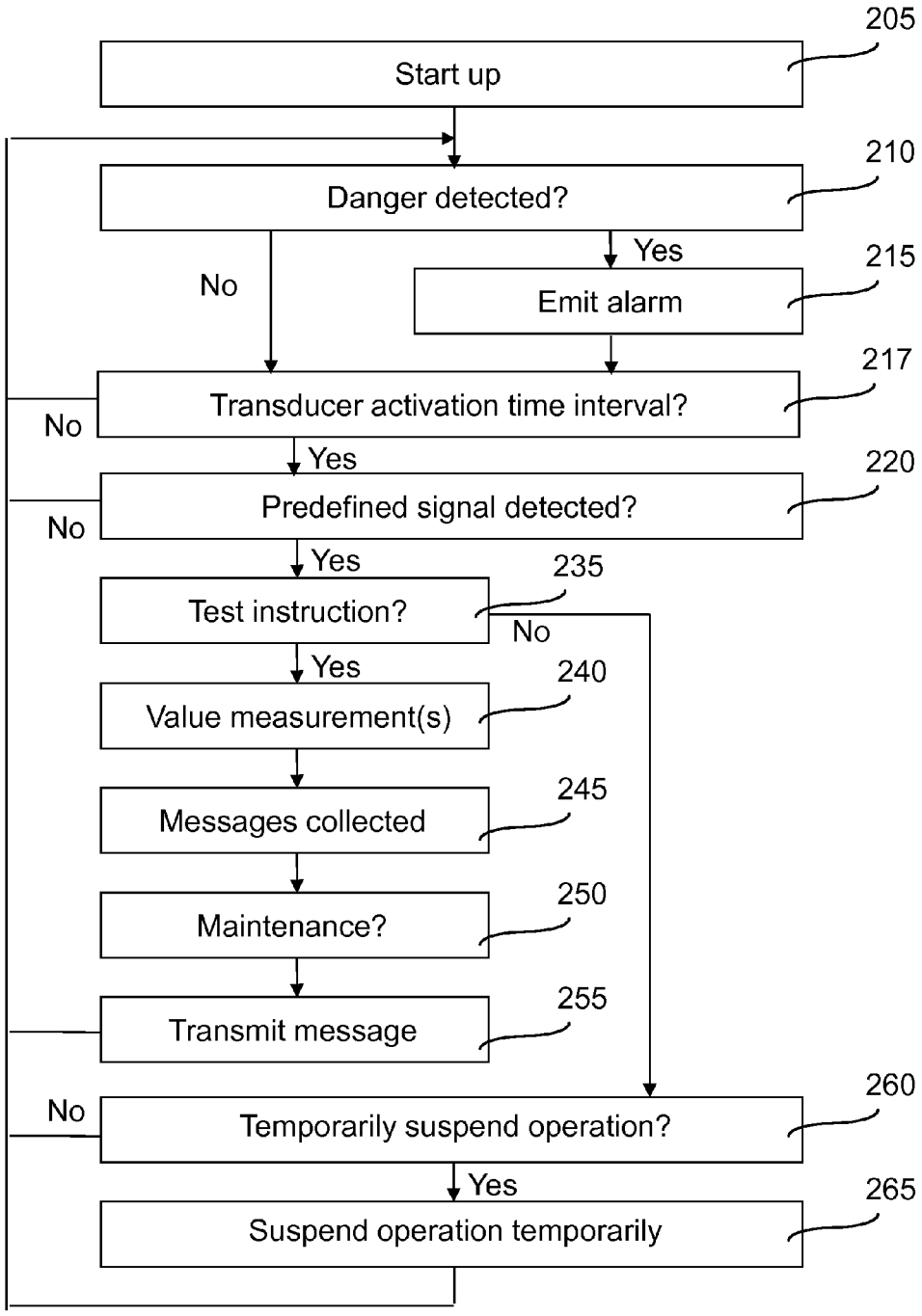
FIG. 5 represents, in the form of a logical diagram, steps utilized in a second particular embodiment of the method that is the subject of this invention.

FIG. 5 shows, in a second embodiment of the method, steps 205 to 220 of FIG. 3.

However, a step 217, of activating an acousto-electric transducer at regular intervals, is shown between step 215 and step 220. For example, the acousto-electric transducer is activated by powering it up, preferably jointly with the means of amplifying its output signal. In embodiments, the transducer is activated after the emission of a light signal, as described elsewhere. For example, the transducer is activated every ten or twenty seconds. In the embodiment shown in FIG. 5, during step 217 it is determined whether this is a period when the transducer is activated; if it is, the transducer is activated or kept activated before going to step 220. If this is not an activation period for the transducer, the transducer is deactivated or kept deactivated and one goes back to step 210.

If the result of step 220 is positive, during a step 235 the control means 130 determines whether the recognized predefined signal is an instruction to test the detection device. If not one goes to step 260. In yes, during a step 240 a value measurement similar to that of step 225 of FIG. 3 is performed. Then, during a step 245 the detection device collects operating test results for other equivalent detection devices. To this end, the detection device emits a predefined test instruction sound signal with sufficient power for the other detection devices to receive it and waits to receive, in return, the sound messages representative of the operating conditions of the other detection devices. Preferably, an emission order is implemented, either during the interrogation by the device 105, for example by successively identifying the other devices in the test instruction messages and waiting for their response before proceeding to the next detection device or, during installation, by providing for staggered response times for the other detection devices. For example each of the other detection devices is assigned, by programming or electrical jumpers, a time interval during which it must, from the reception of a test instruction, emit its response.

Once the messages have been collected, during a step 250 the control means determines whether maintenance must be carried out on the detection installation comprising the detection devices, based on the results of the operating parameter results.

Then, during a step 255 the detection device 105 emits a sound message representative of the measurement results and the possible need for maintenance operations. This message may be destined for the user, the server 175, via the device 155 and the network 170, or for a home automation system designed to communicate remotely and/or display text messages in plain text.

Following step 255 one goes back to step 210. If the result of step 235 is negative, during a step 260 it is determined whether the recognized predefined signal during step 220 is an instruction to temporarily suspend operation. If not, go back to step 210. If yes, during a step 265, the detection device's operation is suspended and, if they are designed to communicate with each other, other equivalent detection devices' operations are also suspended. Then after a predefined delay time, e.g. three hours, one goes back to step 210.

Thus, the user can carry out activities likely to trigger an alarm during this delay time, such as smoke, light a fire in a fireplace or cook food.

Thanks to the utilization of the second embodiment of the method that is the subject of this invention, a user can test each of their detection devices, at the same time and without having to physically reach the detection device, and know whether maintenance operations are necessary. Thus it is even easier to respect the regularity of the operating tests.

Preferably for each of the embodiments described above means, especially software, are provided to reduce electric power consumption.

In embodiments the control means 130 only starts up the acousto-electric transducer, 135 or 145, and/or any amplifier amplifying the electrical signal it emits, at a regular time interval.

In variants of these embodiments, the duration of these time intervals is several seconds and the electronic device 155 is designed to emit the predefined sound signal during a length of time greater than this time interval and, preferably, twice this time interval.

In variants of these embodiments, an indicator light is provided, e.g. a light-emitting diode ("LED"), which lights up briefly to indicate to the user when to have the predefined sound signal emitted. In these variants, the duration of the time interval can be extended to several tens of seconds.

The invention claimed is:

1. An autonomous detection device for detecting smoke, gas, fire or flames, comprising:

a sensor sensitive to smoke, gas, fire or flames;

a power supply;

an alarm emitting an alarm signal when the sensor detects smoke, gas, fire or flames;

an acousto-electric transducer only activated, when the sensor does not detect smoke, gas, fire or flames, at time intervals to receive an acoustic signal and to emit an electrical signal representative of the acoustic signal; and a controller for recognizing a predefined acoustic signal according to the electrical signal emitted by the transducer and triggering an emission of a state message by the alarm, when the sensor does not detect smoke, gas, fire or flames, to confirm that the detection device is operating correctly and when the predefined acoustic signal is recognized.

2. The device of claim 1, wherein the acousto-electric transducer comprises the alarm.

3. The device of claim 1, wherein the acousto-electric transducer comprises a microphone.

4. The device of claim 1, further comprising analyzing means for analyzing values of operating parameters of the detection device and means for generating the message representative of one of the values of the operating parameters.

5. The device according to claim 4, wherein the analyzing means estimates a quantity of remaining energy available in the power supply; and wherein the message is representative of the remaining energy quantity.

6. The device of claim 1, wherein the controller detects a predefined signal requesting a temporary suspension of the detection device's operation and triggers the temporary suspension of the detection device's operation for a predefined length of time in response to the predefined signal.

7. The device of claim 1, wherein the controller recognizes a human voice and a message conveyed by the human voice.

8. The device of claim 1, further comprising means for generating a sound message recognizable by the detection device.

9. The device of claim 1, further comprising means of generating a sound message recognizable by a home automation device.

10. The device of claim 1, further comprising an indicator light commanded to emit a light signal at regular time intervals, the acousto-electric transducer and an amplifier associated with the acousto-electric transducer are only activated during a part of a regular time interval following an emission of the light signal.

11. The device of claim 1, wherein the controller recognizes predefined acoustic signals emitted by an electronic device comprising means of emitting the predefined acoustic signals.

12. The device of claim 11, wherein the electronic device comprises a mobile telephone.

13. A detection system comprising the detection device of claim 1 and an electronic device; wherein the acousto-electric transducer and an amplifier associated with the acousto-electric transducer are only activated at the time intervals; and wherein the electronic device emits the predefined acoustic signal during a length of time greater than the time interval.

14. The detection system of claim 13, wherein length of time greater than the time interval is greater than twice the time interval.

15. A detection system comprising the detection device of claim 1, an electronic device; and a server comprising means for receiving a request from the electronic device and means of providing the predefined acoustic signal to be recognized by the controller of the detection device.

16. An autonomous detection method utilizing a sensor sensitive to smoke, gas, fire or flames, a power supply and an alarm emitting an alarm signal when the sensor detects smoke, gas, fire or flames, the method comprising the steps of:

activating an acousto-electric transducer only, when the sensor does not detect smoke, gas, fire or flames, at time intervals;

receiving an acoustic signal by the activated transducer; and recognizing a predefined acoustic signal and triggering an emission of a state message by the alarm, when the sensor does not detect smoke, gas, fire or flames, to confirm that the detection device is operating correctly and when said predefined signal is recognized.

17. A method of emitting the predefined acoustic signal, comprising the steps of triggering a function of an electronic device and emitting the predefined sound signal to be recognized by the detection device of claim 1.

18. A method of providing the predefined acoustic signal, comprising the steps of receiving a request from an electronic device and providing the predefined sound signal to be recognized by the detection device of claim 1.

* * * * *